United States Patent [19]

Muzslay

[11] Patent Number: 4,988,307

[45] Date of Patent: Jan. 29, 1991

[54] CIRCUIT SHORTING CONNECTOR

[75] Inventor: Steven Z. Muzslay, Huntington Beach, Calif.

[73] Assignee: ITT Corporation, New York, N.Y.

[21] Appl. No.: 419,351

[22] Filed: Oct. 10, 1989

[51] Int. Cl.[5] ..... H01R 13/703

[52] U.S. Cl. ..... 439/188; 200/51.1; 439/596

[58] Field of Search ..... 439/188, 507, 514, 596; 200/51.09, 51.10, 51.11

[56] References Cited

U.S. PATENT DOCUMENTS

| | | | |
|---|---|---|---|
| 2,716,737 | 6/1952 | Maberry | 339/31 |
| 3,512,043 | 5/1970 | Jaaksoo et al. | 200/51.1 |
| 3,600,531 | 8/1971 | Hoegerl | 200/51.1 |
| 3,860,318 | 1/1975 | Reavis, Jr. et al. | 339/99 |
| 3,869,191 | 3/1975 | Tolnar, Jr. et al. | 339/111 |
| 3,903,385 | 9/1975 | Moyer et al. | 200/51.1 |
| 4,070,557 | 1/1978 | Ostapovitch | 200/51.1 |
| 4,106,841 | 8/1978 | Vladic | 339/176 |
| 4,152,041 | 5/1979 | Hollyday et al. | 339/147 |
| 4,170,939 | 10/1979 | Hoheisel et al. | 102/28 |
| 4,186,984 | 2/1980 | Reavis, Jr. et al. | 339/103 |
| 4,224,486 | 9/1980 | Zimmerman, Jr. et al. | 200/51.1 |
| 4,274,691 | 6/1981 | Abernethy et al. | 339/19 |
| 4,330,164 | 5/1982 | Pittman et al. | 339/49 |
| 4,382,156 | 5/1983 | Jodoin | 174/72 |
| 4,438,303 | 3/1984 | Astier | 200/51.1 |
| 4,449,778 | 5/1984 | Lane | 339/143 |
| 4,457,570 | 7/1984 | Bogese, II | 339/17 |
| 4,501,459 | 2/1985 | Chandler et al. | 339/48 |
| 4,514,030 | 4/1985 | Triner et al. | 339/176 |
| 4,582,376 | 4/1986 | Olsson | 339/19 |
| 4,685,887 | 8/1987 | Hanning | 439/188 |
| 4,894,019 | 1/1990 | Howard | 439/188 |

*Primary Examiner*—Neil Abrams

*Attorney, Agent, or Firm*—Thomas L. Peterson

[57] ABSTRACT

A connector system is described, of the type which includes a connector with a pair of contacts and a spring-operated device that shorts the contacts until the connector is mated with another pair of contacts, which is of simple and reliable construction. The spring-operated device includes a largely Z-shaped spring (24, FIG. 2) lying in a slot (30) in a connector housing, with the middle of the spring supported by the slot walls and with opposite ends of the spring resiliently biased against the contacts. The housing is an integrally-molded part with first and second housing parts (50, 52) joined by a hinge, and with the first part having a pair of elongated holes (64, 65) for receiving first and second contacts (16, 18) and with a second housing part having a pair of elongated holes (82, 84) for receiving the mating contacts.

9 Claims, 4 Drawing Sheets

FIG. 4.
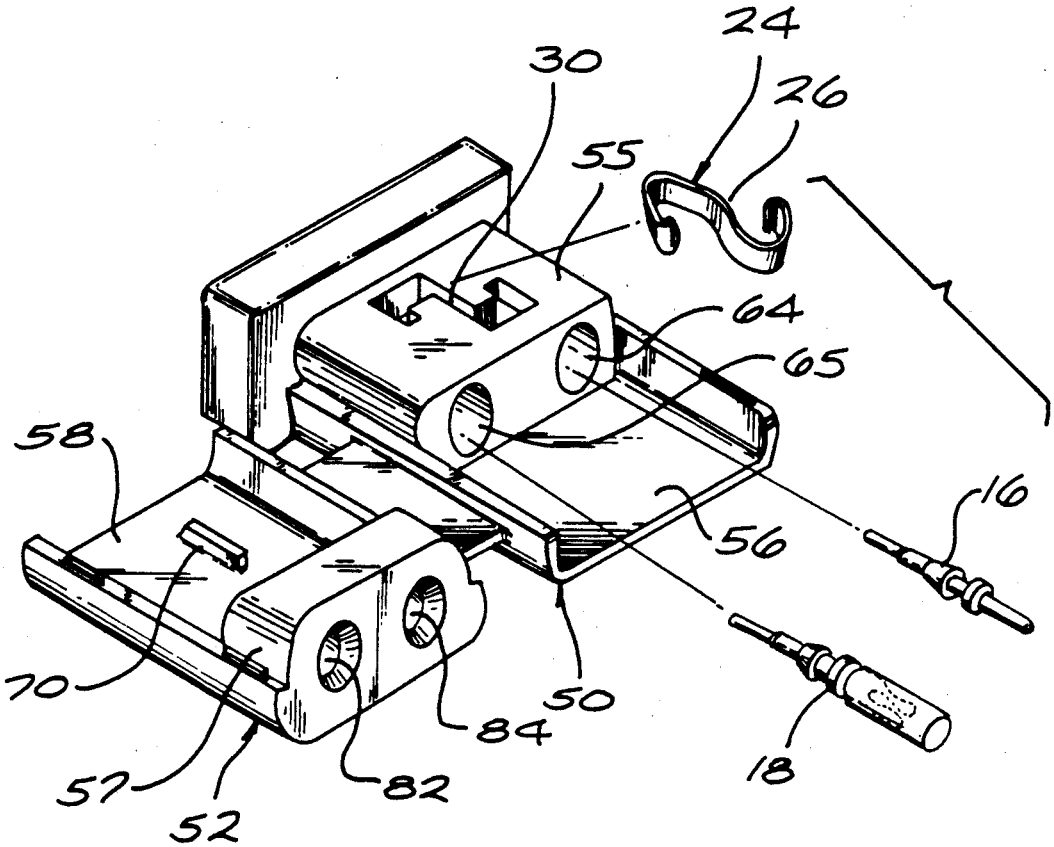
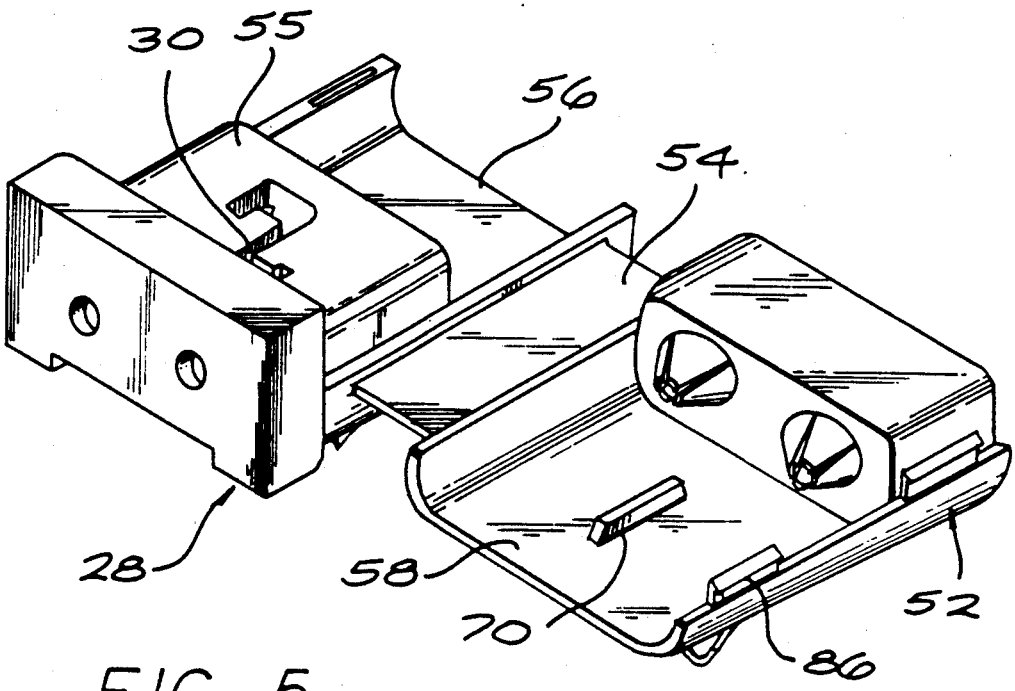
FIG. 5

CIRCUIT SHORTING CONNECTOR

BACKGROUND OF THE INVENTION

One type of connector includes a pair of contacts that are shorted to each other until mated with another pair of contacts. One application is a connector that delivers energizing current to a device that blows up an air bag. It is important that the connector contacts be shorted during transport and storage, and until connected to an energizing circuit, to prevent accidental operation as from static electricity or radio waves. U.S. Pat. Nos. 3,600,531, 4,070,557, and 4,152,041 show prior art approaches to such circuit shorting connectors, wherein the outer end of a spring that engages a contact until the contact mates with another contact, has an inner end rigidly mounted on the connector housing at a location removed from both contacts and the space between them. The need to separately rigidly mount the spring increases the cost, and the extra space required for the inner portion of the spring increases the size of the housing. A circuit-shorting connector whose spring could be mounted in a simple and low cost manner, without increasing the size of the connector housing, would be of considerable value.

SUMMARY OF THE INVENTION

In accordance with one embodiment of the present invention, a connector system is provided of the type that includes first and second contacts that are shorted when unmated from other contacts, which is of compact and low cost construction. A spring-operated device for shorting the first and second contacts, includes a spring with a middle lying in the connector housing between the first and second contacts and having opposite end portions biased respectively against the first and second contacts. The housing has a slot lying between the first and second contacts, with the middle of the spring captured in the slot. The housing can include first and second housing parts that can be snapped together. The first housing part forms elongated holes into which the first and second contacts can be snapped, and also forms the slot so the spring can lie in a plane that includes the axes of the first and second contacts. The second housing part covers the slot and traps the spring in place. The second housing part also has elongated holes for receiving and holding third and fourth contacts that mate with the first and second contacts.

The novel features of the invention are set forth with particularity in the appended claims. The invention will be best understood from the following description when read in conjunction with the accompanying drawings.

BRIEF DESCRIPTION OF THE DRAWINGS

FIG. 4 is a front perspective view of the connector system of FIG. 2, with the housing in an open position.

FIG. 5 is a rear perspective view of the connector of FIG. 2, with the housing in an open position.

DESCRIPTION OF THE PREFERRED EMBODIMENT

Figure 1:
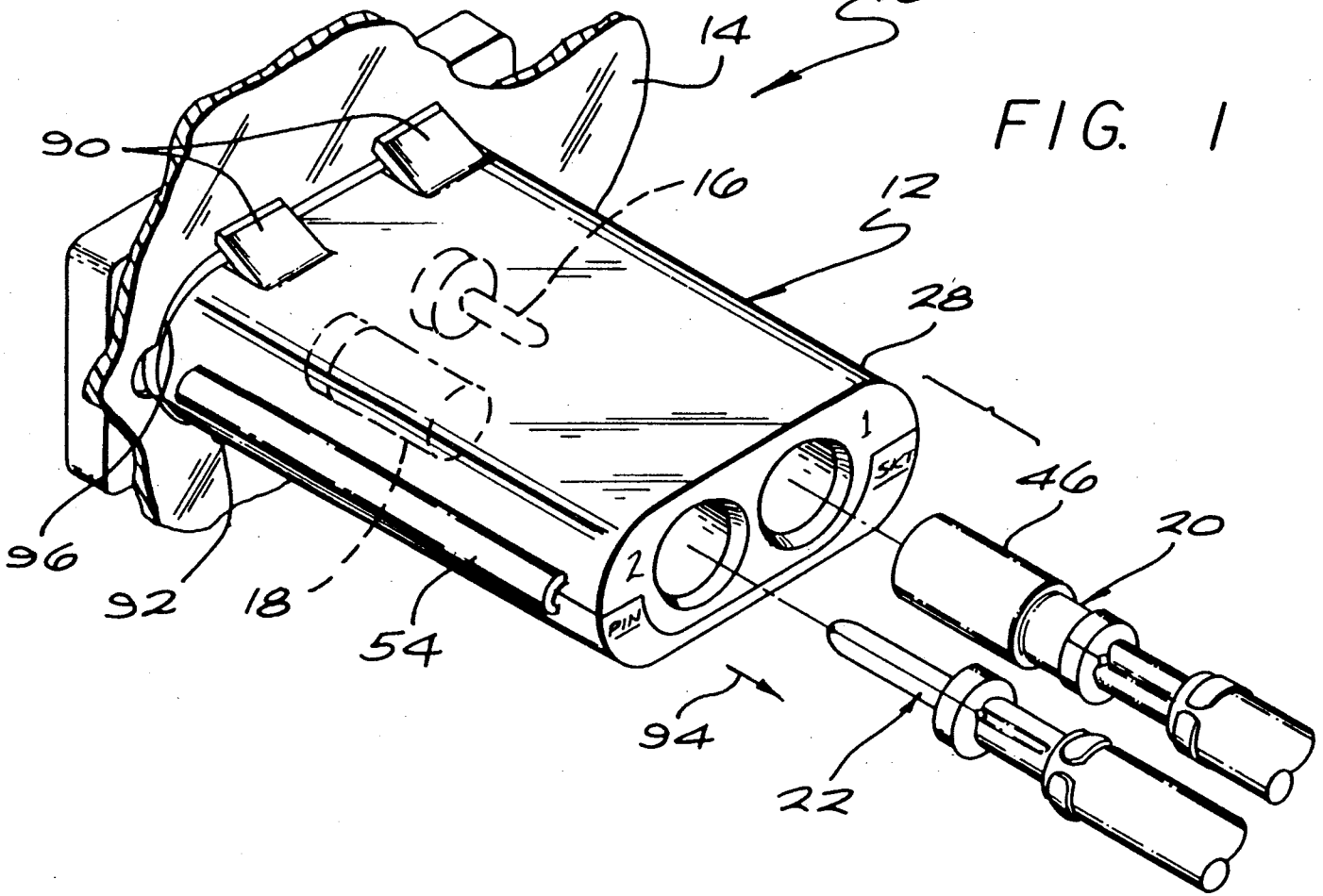
FIG. 1 is a front perspective view of a connector system constructed in accordance with the present invention, showing the connector mounted on a bulkhead and showing a pair of mating contacts.

FIG. 1 illustrates a connector system 10 that is used to operate a vehicle air bag. The system includes a connector 12 mounted on a bulkhead or wall 14 and having first and second contacts 16, 18. The contacts 16, 18 are connected to a pyrotechnic device (not shown) that rapidly inflates the air bag when an energizing signal is delivered over the contacts. The system also includes third and fourth contacts 20, 22 that extend from circuitry for sensing a crash and for delivering electrical signals through the contacts 20, 22 to energize the pyrotechnic device.

Figure 2:
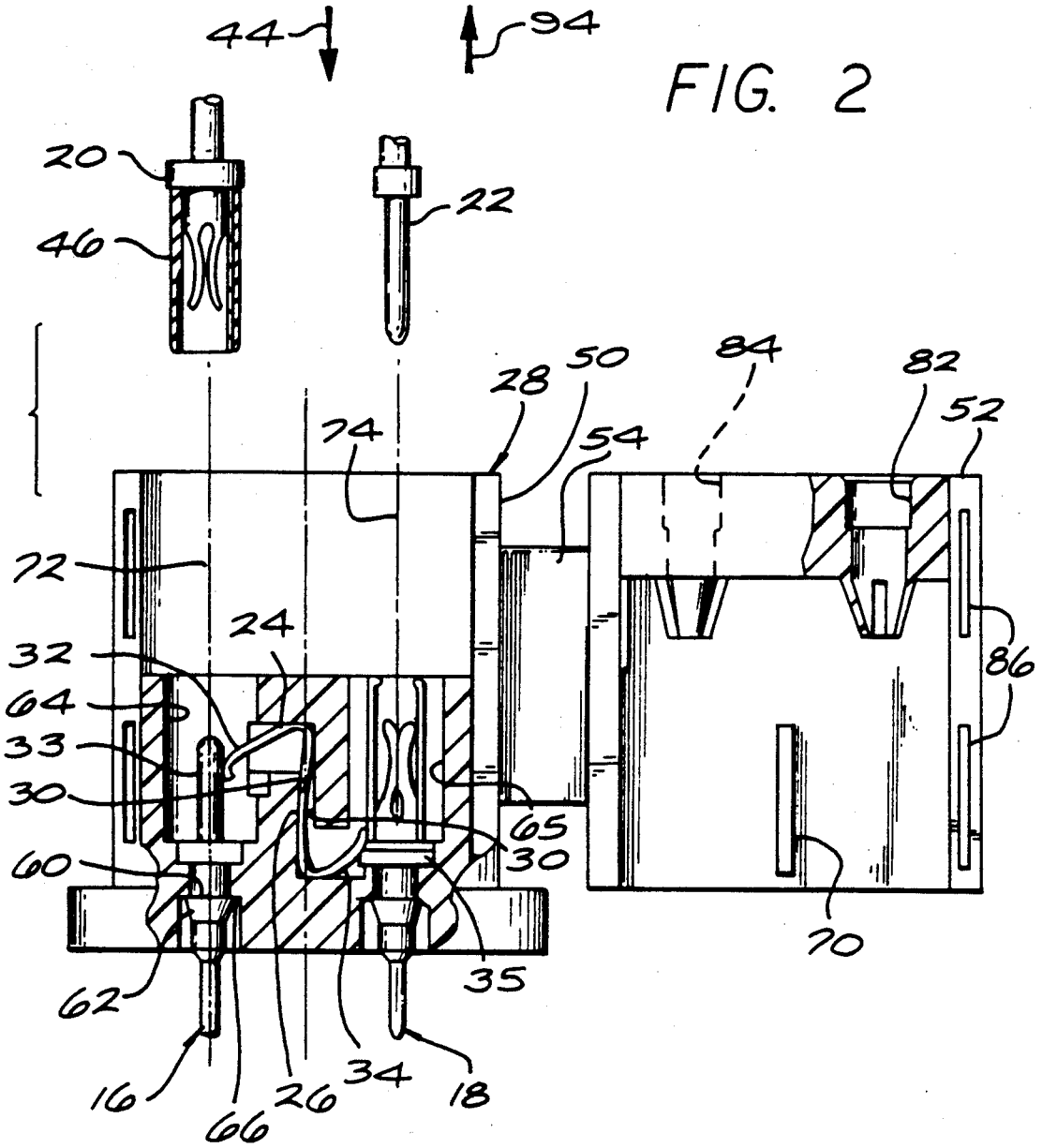
FIG. 2 is a partially sectional view of the connector of FIG. 1, with the housing in an open position, and also showing the mating contacts.

FIG. 2 shows a spring 24 that connects or shorts the contacts 16, 18. The spring, also shown in FIG. 3, has a middle 26 that is captured in an insulative housing 28 of the connector, in a housing slot 30. A first end portion 32 of the spring is resiliently biased against a front mating part 33 of the first contact 16, while a second end portion 34 of the spring is resiliently biased against a rear part 35 of the second contact 18. The two spring end portions 32, 34 extend from opposite parts 40, 42 (FIG. 3) of the spring middle 26.

The third contact 20 which is a socket type, moves in a first or mating direction 44 to engage the first contact 16 which is a pin type. The spring first end portion 32 extends partially in the first direction 44 from the spring middle to the first contact. As the third contact approaches the first contact, an insulative shield or sheath 46 on the third contact deflects the spring first end portion 32 out of engagement with the first contact, to break the short circuiting of the first and second contacts. The sheath 46 is of dielectric, or insulative material to break the electrical connection. It may be noted that the spring second end portion 34 remains in constant engagement with the second contact 18 regardless of its engagement or disengagement from the fourth contact.

The connector housing 28 is formed of first and second parts 50, 52 and a hinge 54 that connects the first and second parts. All three portions 50–54 of the housing are integrally molded of a plastic (high molecular weight polymer) material. The housing is initially molded in the open position shown in FIG. 2. The first and second contacts 16, 18 and spring 24 are installed while the housing is open. Thereafter, the second housing part 52 is moved over and locked to the first housing part, to form the closed housing configuration shown in FIG. 1. As shown in FIG. 4, the first housing part 50 has a thick portion 55 containing contact-receiving holes 64, 65, and has a thin portion 56. Similarly, the second housing part 52 has a thick portion 57 containing contact-receiving holes 82, 84 and a thin portion 58. When the two housing parts are brought together, the thin portion 56, 58 of each lies facewise adjacent to the thick portion 57, 55 of the other housing part.

The first and second contacts 16, 18 are each formed with a snap-in shoulder 60 lying at the front of a tapered contact part 62. With the housing in the open position, each contact such as 16 is moved in the first or rearward direction 44 into an elongated hole 64 in the first housing part until the shoulder 60 snaps behind a corresponding shoulder 66 formed in the housing, to thereby lock the contact in place. The spring 24 is then moved down into the slot 30, and its ends deflected so they bear against the first and second contacts. The second housing part 52 can then be snapped closed over the first part. As shown in FIG. 4, the second housing part 52 has a retainer 70 that enters the spring-holding slot 30 to hold the middle 26 of the spring in the housing slot.

Figure 3:
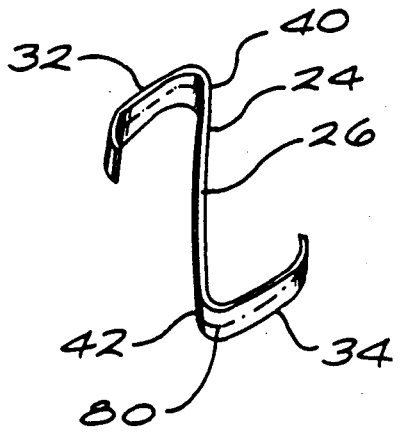
FIG. 3 is a perspective view of the spring of the connector of FIG. 2.
Figure 7:
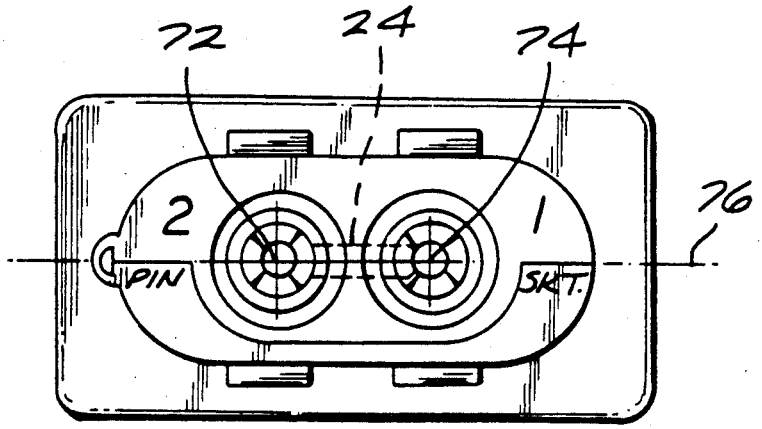
FIG. 7 is a front elevation view of the connector of FIG. 1.

The first and second contacts have parallel axes 72, 74. Thus, as shown in FIG. 7, the two axes 72, 74 lie in a common imaginary plane 76. The spring 24 also lies in this common plane 76, in a location between the two contacts. By positioning the spring in substantially the same plane as the contacts and at a location between the contacts, applicant avoids enlarging the connector to accommodate the spring. Instead, the connector is of compact construction, being as compact as it would be without the springs. As shown in FIG. 3, the spring is formed of a strip of highly conductive spring material, such as a copper alloy. The strip of material of the spring has a centerline 80, which preferably lies approximately on the common plane that includes the axes of the first and second contacts.

The second housing part 52 (FIG. 2) includes two elongated holes 82, 84 that receive the third and fourth contacts 20, 22 and help keep them aligned with the axes of the first and second contacts when the two pairs of contacts are mated. The second housing part also has a pair of latches 86 that lock onto corresponding parts of the first housing, to lock the two housing parts together when the housing is closed.

Figure 6:
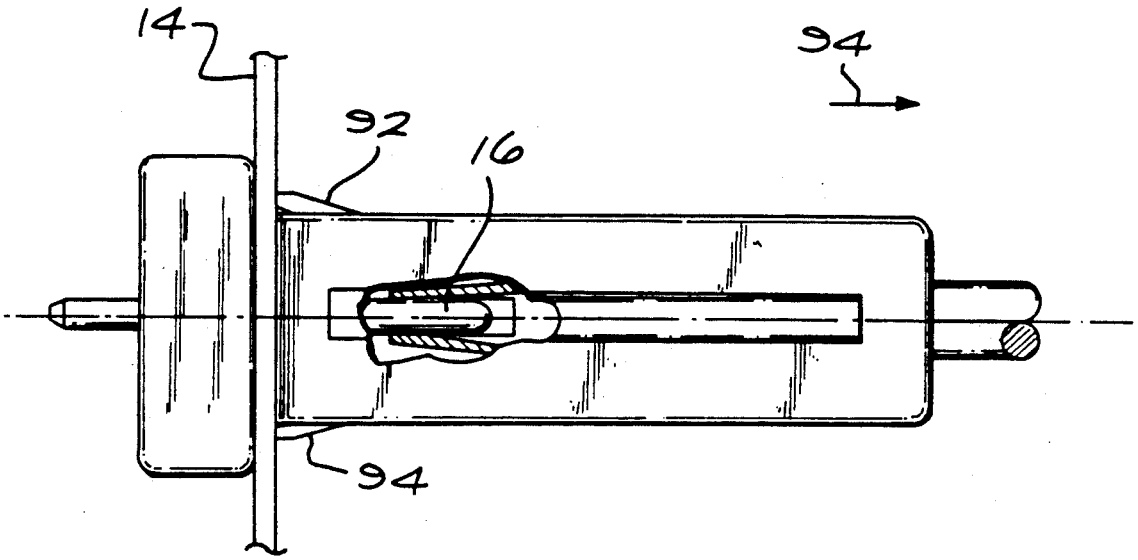
FIG. 6 is a side elevation view of the connector of FIG. 1.

As shown in FIGS. 1 and 6, each housing part also has pairs of locking tabs 90, 92 for locking to the bulkhead 14. This is accomplished by inserting the closed connector in the forward or unmating direction 94 through a hole 96 in the bulkhead, until the tabs snap against the front face of the bulkhead.

Thus, the invention provides a circuit shorting connector system which is of compact and low cost construction. The system includes a connector with first and second contacts and a spring for connecting them that lies lying between the contacts in substantially the same plane as the axes of the contacts. The spring can include a strip of spring material that lies in a slot formed in the housing, with the middle of the spring lying closely in the housing and with opposite end portions of the spring biased respectively against the first and second contacts. The housing can be formed as two parts, with the slot in a first part and with second part covering the slot when the two housing parts are snapped together. Each housing part can be formed with elongated contact-receiving holes, with the pairs of holes of the two housing parts being aligned when the housing parts are brought together.

Although particular embodiments of the invention have been described and illustrated herein, it is recognized that modifications and variations may readily occur to those skilled in the art and consequently it is intended to cover such modifications and equivalents.

What is claimed is:

1. In a connector system that includes a connector having first and second contacts that are matable with third and fourth contacts, said third contact being a socket contact and said first contact being a pin contact with a front part that mates with said third contact, and said first and second contacts have parallel axes lying in a common imaginary plane, the connector including a housing and a spring-operated device in the housing that short circuits the first and second contacts when they are not mated to the third and fourth contacts, the spring-operated device being deflected out of engagement with said first contact by said third contact as it moves in a direction to approach and mate with said first contact, the improvement wherein:

said spring-operated device includes a strip of spring material having a centerline extending along its length with said centerline lying substantially in said imaginary plane, said strip having opposite strip ends based against said first and second contacts, a first of said strip ends bearing against said front part of said first contact to be deflected by said third contact into the space between said first and third contacts.

2. In a connector system that includes a connector having first and second contacts that are matable with third and fourth contacts, the connector including a housing and a spring-operated device in the housing that short circuits the first and second contacts when they are not mated to the third and fourth contacts, the spring-operated device being deflected out of engagement with said first contact by said third contact as it moves in a first direction to approach and mate with said first contact, the improvement wherein:

said housing includes a slot having a middle extending largely in said first direction and slot ends at opposite ends of said middle extending from opposite sides of said middle respectively to said first and second contacts;

said spring-operated device including a strip of spring material having a middle lying in said slot middle, and opposite end portions lying in said slot ends and extending respectively to said first and second contacts and biased against them.

3. The improvement described in claim 2 wherein:

said housing includes first and second parts, said first and second contacts lying in said first housing part and said slot being formed in said first housing part;

said second housing part including a projection that projects into said slot middle to closely locate said spring middle.

4. In a connector system that includes a connector having first and second contacts that are matable with third and fourth contacts, the connector including a housing and a spring-operated device in the housing that short circuits the first and second contacts when they are not mated to the third and fourth contacts, the spring-operated device being deflected out of engagement with said first contact by said third contact as it moves in a direction to approach and mate with said first contact, the improvement wherein:

said housing includes first and second housing parts that can be deployed from an open position to a closed position and having a latch for holding them together in said closed position, said first housing part having first and second contact-receiving holes holding said first and second contacts and a spring-holding slot extending between said holes;

said spring-operated device comprises a spring lying in said slot and biased against said first and second contacts;

said slot being open in said open position of said housing, but said second housing part covering said slot in said closed position of said housing.

5. The improvement described in claim 4 wherein:

said first and second housing parts each has thick and thin portions, the thick portion of said first housing part forming said first and second holes and said slot, and the thick portion of said second housing part forming third and fourth holes that receive said third and fourth contacts;

said housing parts constructed so in said closed housing position said third and fourth holes in said second housing part are aligned respectively with said first and second holes in said first housing part, and the thin portions of said first and second housing parts lie facewise adjacent to the thick portions of said second and first housing parts, respectively.

6. In a connector system that includes a connector having first and second contacts that are matable with third and fourth contacts, said first and second contacts having parallel axes lying in a common imaginary plane, the connector including a housing and a spring-operated device in the housing that short circuits the first and second contacts when they are not mated to the third and fourth contacts, the spring-operated device being deflected out of engagement with said first contact by said third contact as it moves in a direction to approach and mate with said first contact, the improvement wherein:

said spring-operated device includes a spring formed of a strip of spring material bent into a largely z-shape, said strip having a centerline extending along its length and lying substantially in said imaginary plane, said strip having opposite end portions biased against said first and second contacts.

7. In a connector system that includes a connector having first and second contacts that are matable with third and fourth contacts, the connector including a housing and a spring-operated device in the housing that short circuits the first and second contacts when they are not mated to the third and fourth contacts, the spring-operated device being deflected out of engagement with said first contact by said third contact as it moves in a direction to approach and mate with said first contact, the improvement wherein:

said spring-operated device includes a spring having a middle lying in said housing directly between said first and second contacts, said spring having opposite spring end portions biased against said first and second contacts;

said housing has first and second contact-holding holes holding said first and second contacts, and said housing has a slot lying between said holes, said slot having a middle portion extending largely parallel to said contact axes and holding said spring middle, and said slot having opposite end portions opening respectively to said first and second contact-receiving holes and holding said spring opposite end portions.

8. In a connector system that includes a connector having first and second contacts that are matable with third and fourth contacts, the connector including a housing and a spring-operated device in the housing that short circuits the first and second contacts when they are not mated to the third and fourth contacts, the spring-operated device being deflected out of engagement with said first contact by said third contact as it moves in a direction to approach and mate with said first contact, the improvement wherein:

said spring-operated device includes a spring having a middle lying in said housing directly between said first and second contacts, said spring having opposite spring end portions biased against said first and second contacts, said housing has first and second hingedly joined parts and a latch that keeps said housing parts together when pivoted together, said first and second contacts being mounted in said first housing part, and said first housing part having a largely Z-shaped slot extending between said first and second contacts;

said spring is largely Z-shaped and lies in said housing slot;

said second housing part covers said slot and forms a retainer that enters said slot to hold said spring down in said slot, when said housing parts are pivoted together.

9. In a connector system that includes a connector having first and second contacts that are matable with third and fourth contacts, the connector including a housing and a spring-operated device in the housing that short circuits the first and second contacts when they are not mated to the third and fourth contacts, the spring-operated device being deflected out of engagement with said first contact by said third contact as it moves in a direction to approach and mate with said first contact, the improvement wherein:

said spring-operated device includes a spring having a middle lying in said housing directly between said first and second contacts, said spring having opposite spring end portions biased against said first and second contacts;

said first contact is a pin contact with a front part that mates with said third contact, and said spring first end portion is biased against said pin contact front part;

said second contact is a socket contact with a front part that mates with said fourth contact and with a rear part spaced rearward from said front part, said spring second end portion being biased against said rear part of said second contact.

* * * * *